United States Patent [19]

Zmiarovich

[11] 4,109,333

[45] Aug. 29, 1978

[54] AIR STABILIZED WATER MATTRESS

[75] Inventor: Thomas George Zmiarovich, Sumnar, Wash.

[73] Assignee: The Raymond Lee Organization, Inc., New York, N.Y.

[21] Appl. No.: 771,412

[22] Filed: Feb. 23, 1977

[51] Int. Cl.[2] ..... A47C 27/08

[52] U.S. Cl. ..... 5/368; 5/370

[58] Field of Search ..... 5/365, 366, 367, 368, 5/369, 370, 371

[56] References Cited

U.S. PATENT DOCUMENTS

| | | | |
|---|---|---|---|
| 2,237,012 | 4/1941 | Sampson | 5/365 |
| 2,434,641 | 1/1948 | Burns | 5/365 |
| 3,294,387 | 12/1966 | Chavannes | 5/368 |
| 3,746,835 | 7/1973 | Yu et al. | 5/370 |
| 4,006,501 | 2/1977 | Phillips | 5/371 |

*Primary Examiner*—Peter M. Caun

*Attorney, Agent, or Firm*—Howard I. Podell

[57] ABSTRACT

A waterbed mattress, the interior of which is fitted with an air inflatable section in the form of cylindrical cup sections joined to the interior of the top and bottom liners of the mattress. The interior of the cup sections are open to the bottom with the cups joined together, to form a common air chamber, bounded by the bottom liner, with valves provided for independent filling of the water chamber and the air chamber.

1 Claim, 3 Drawing Figures

AIR STABILIZED WATER MATTRESS

SUMMARY OF THE INVENTION

My invention is a waterbed mattress, the interior of which is fitted with an air inflatable section in the form of cylindrical cup sections joined to the interior of the top and bottom liners of the mattress. The interior of the cup sections are open to the bottom with the cups joined together, to form a common air chamber, bounded by the bottom liner, with valves provided for independent filling of the water chamber and the air chamber.

By means of my invention, the weight of the mattress is considerably reduced from that of a conventional waterbed mattress. The mattress air chamber may be initially partially inflated prior to filling with water to fit the mattress frame and the pressure of the air chamber may be adjusted by further inflation or deflation to adjust the firmness of the mattress to suit the weight of the user. The cups provide an internal barrier to movement of water in the water chamber.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
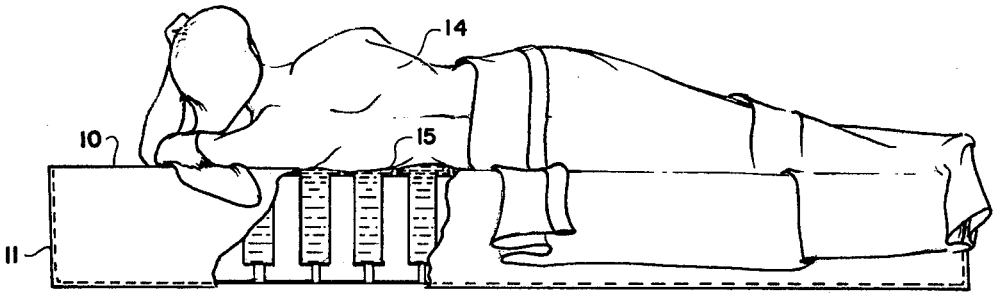
FIG. 1 is a side view of the mattress in use.
Figure 2:
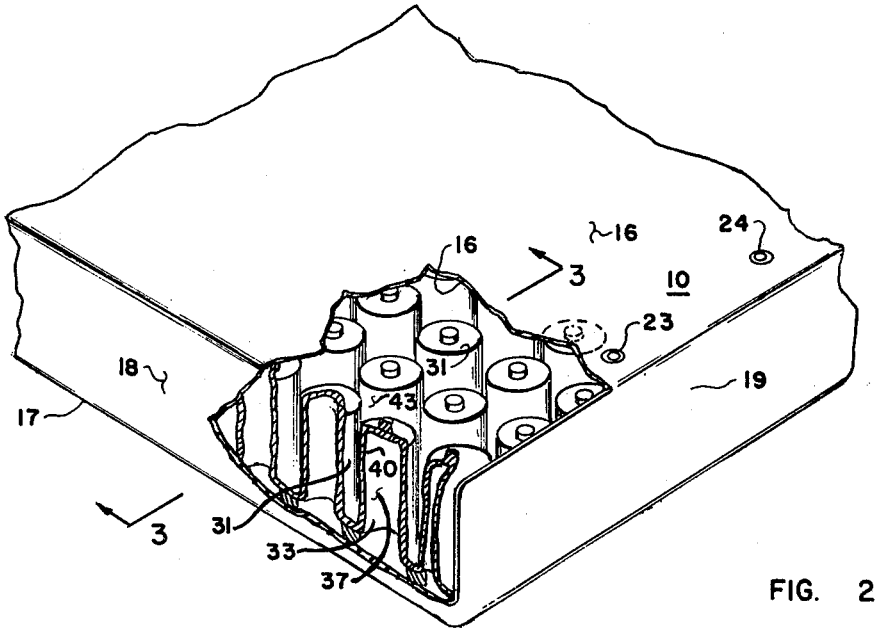
FIG. 2 is a partially sectioned perspective view of the invention.
Figure 3:
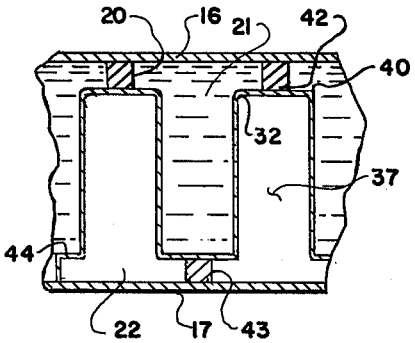
FIG. 3 is a detail sectional view of the invention.

Turning now descriptively to the drawings, in which similar reference characters denote similar elements throughout the several views, FIGS. 1–3 illustrate the mattress 10 which may be enclosed in an open box frame 11 for support of a reclining person 14 with the external surface 15 of the upper liner 16 of the mattress conforming to the profile of the person 14.

Mattress 10 is formed of an upper liner 16 and a lower liner 17 joined by side walls 18 and end walls 19 to bound an upper chamber 21 which may be filled with water through a fill valve 23 and a lower chamber 22 that may be inflated with air through a fill valve 24, with a shaped internal flexible partition wall 40 dividing chamber 21 from chamber 22.

Partition wall 40 is formed as a plurality of hollow spaced cylinders 31, each formed with a closed top cover section 32 and an open mouth section 33, joining the interior 37 of each cylinder 31 to chamber 22.

A plug 42 spaces each cover section 32 internally to the upper liner 16 and plugs 43 space the lower section 44 of partition wall 40 from lower liner 17.

In use, the empty mattress 10 may be placed in the frame 11 and air inflated in lower chamber 22 through fill valve 24 to expand the mattress in the frame. Water is then added in upper chamber 21 through fill valve 23 to fill chamber 21. Both fill valves 24 and 23 are preferably located in the upper liner 16, with air valve 24 connected internally by tubing to lower chamber 22.

Since obvious changes may be made in the specific embodiment of the invention described herein, such modifications being within the spirit and scope of the invention claimed, it is indicate that all matter contained herein is intended as illustrative and not as limiting in scope.

Having thus described the invention, what I claim as new and desire to secure by Letters Patent of the United States is:

1. An inflatable mattress formed with an internal upper chamber and an internal lower chamber, said chambers divided by a shaped internal flexible partition, with the upper chamber bound by the top liner of the mattress and the lower chamber bound by the bottom liner of the mattress, with each chamber provided with independent valve means so that the upper chamber may be filled with water and the lower chamber inflated with air in which the partition is shaped to form a plurality of spaced hollow cylindrical sections extending between the top and the bottom liners of the mattress and spaced from said top and bottom liners, with the interior of said cylindrical sections open to the lower chamber and closed to the top chamber, together with spacer means mounted to the partition to space the cylindrical sections between the top liner and the lower liner.

* * * * *